US006945005B2

(12) United States Patent
Nunley

(10) Patent No.: US 6,945,005 B2
(45) Date of Patent: Sep. 20, 2005

(54) ROOF DECK AND PARAPET STRUCTURE

(76) Inventor: C. Lynn Nunley, 5945 W. Andechs Summit, Duluth, GA (US) 30097

( * ) Notice: Subject to any disclaimer, the term of this patent is extended or adjusted under 35 U.S.C. 154(b) by 0 days.

(21) Appl. No.: 10/748,772

(22) Filed: Dec. 30, 2003

(65) Prior Publication Data

US 2004/0154253 A1 Aug. 12, 2004

Related U.S. Application Data

(62) Division of application No. 09/614,016, filed on Jul. 11, 2000, now Pat. No. 6,751,923.

(51) Int. Cl.[7] ..... E04D 1/36

(52) U.S. Cl. ..... 52/650.3; 52/96; 52/60; 52/61

(58) Field of Search ..... 52/60, 61, 62, 52/96, 97, 475.1, 650.3, 307.6, 278, 408, 409, 58

(56) References Cited

U.S. PATENT DOCUMENTS 3,024,573 A * 3/1962 McKinley ..... 52/96
3,365,847 A * 1/1968 Alexander ..... 52/94
3,488,902 A * 1/1970 Klaus ..... 52/94
3,735,540 A * 5/1973 Thaler ..... 52/94
3,979,860 A * 9/1976 Roth et al. ..... 52/61
4,120,122 A * 10/1978 Bahr ..... 52/58
4,741,132 A * 5/1988 Emblin ..... 52/58
5,027,572 A * 7/1991 Purcell et al. ..... 52/309.9
6,006,482 A * 12/1999 Kelly ..... 52/409
6,167,660 B1 * 1/2001 Sama ..... 52/58
6,237,293 B1 * 5/2001 Gembala ..... 52/302.6
6,421,971 B1 * 7/2002 Gembala ..... 52/302.6
6,578,322 B2 * 6/2003 Kintop ..... 52/96

* cited by examiner

*Primary Examiner*—Brian E. Glessner
*Assistant Examiner*—Basil Katcheves
(74) *Attorney, Agent, or Firm*—Peter V. Schroeder; Crutsinger & Booth, LLC

(57) ABSTRACT

A roof transition assembly for a roof deck having a corrugated sheet and a rigid sheet wherein a base component is positioned at the perimeter of the roof deck and has two legs. The first leg secures the base component to the corrugated sheet, and the second leg extends from the first leg, generally parallel to a free edge of the roof deck. The second leg includes an anchoring surface. An upper component positioned at the perimeter of the roof deck has a connector portion and an anchor portion. The anchor portion is secured to the roof deck, and the connector portion extends from the anchor portion and overlays and is secured to the anchoring surface of the base component, thus anchoring the base component and upper component to the roof deck.

19 Claims, 5 Drawing Sheets

ROOF DECK AND PARAPET STRUCTURE

CROSS-REFERENCE TO RELATED APPLICATIONS

This application is a division Utility Application Ser. No. 09/614,016, filed Jul. 11, 2000, now U.S. Pat. No. 6,751,923, by C. Lynn Nunley entitled "ROOF DECK TERMINATION STRUCTURE," which claims the benefit application of Provisional Application Ser. No. 60/043,522 filed Apr. 15, 1997 by C. Lynn Nunley entitled "ROOF DECK TERMINATION STRUCTURE," now abandoned, the disclosures of which are incorporated herein by reference in their entirety for all purposes.

FIELD OF THE INVENTION

The present invention relates to improved roofing components. More particularly, this invention relates to transition assemblies for protecting and reducing the stresses at roof deck perimeters and parapet walls.

BACKGROUND OF THE INVENTION

Conventional roof deck design typically calls for wood blocking at the termination points of the roof deck assembly and at the transitions between multiple roof decks, such as expansion joints. The wood blocking is used to provide starting and stopping points for the roof decking, roof insulation, and the roof covering, as well as an anchorage medium for sheet metal flashing and gutter hardware. The wood members can be made a part of the assembly, or can act as fillers, independent from the roof deck assembly, being mounted to a wall or other non-roof deck component. Roof deck stress occurs at the joints between the wood blocking and roof assembly and at the termination points of the roof deck.

As relatively thin, plate-like structures, roofs experience diaphragm forces due to building movement induced by wind and seismic loading. These diaphragm forces result in stress between roof components, especially at roof transition and termination points. These stresses are transferred to the wood blocking and roof supporting structure. Further stress is caused by linear expansion and contraction forces. Since the roof components are formed of different materials with different coefficients of thermal expansion, they can undergo significant relative thermal growth. Such relative movement results in local stresses between the roofing and blocking materials and between the roof assembly and the roof support system. These stresses also occur at the junctures between multiple roof assemblies.

Further problems arise with wood blocking as the wood ages. As it dries, the wood shrinks, warps and buckles, losing its dimensional stability and its ability to retain fasteners. This presents problems for building flashing as it causes substrate movement and fastener loosening resulting in leaks and failures.

To deal with these problems, there is need for improved protection from the stresses between the roof deck and the roof supporting structure at the roof deck perimeter and between adjoining roof assemblies.

SUMMARY OF THE INVENTION

A roof transition assembly suitable for roof perimeter and wall transitions. The roof transition assembly is for use with roof decks with a sheet of rigid material and a sheet of corrugated material. The roof transition perimeter assembly comprises a base component and an upper component. The base component has two legs: one secured to the sheet of corrugated material, the second extending upward along the roof deck edge. The base component further has a connecting surface for attachment to the upper component. The upper component has a connector portion and an anchor portion, with the anchor portion secured to the top of the roof deck. The connector portion extends from the anchor portion, overlays, and is secured to, the connecting surface of the base component, thus anchoring the transition assembly to the roof deck.

The transition assembly for a roof deck and a parapet wall has a base component and a wall component. The base component, as in the perimeter assembly, has two legs. The first leg is attached to the corrugated sheet of the roof deck, and the second leg extends generally parallel to and overlaps a portion of the parapet wall. The second leg again has a connecting portion for securement to the wall component. The wall component has a connector portion, and a hook portion. The hook portion extends over the top of the parapet wall, and the connector portion overlays and is secured to the connecting surface of the base component, thus anchoring the transition assembly to the roof deck and parapet wall.

The parapet wall transition assembly can further be fitted with a cant component. The cant component is positioned at the intersection of the parapet wall and the roof deck. The cant component has a central portion and a leg extending from each end of the central portion. One leg is secured to the roof deck and the second leg extends up the parapet wall and is secured to the wall component.

DESCRIPTION OF DRAWINGS

Drawings of a preferred embodiment of the invention are annexed hereto so that the invention may be better and more fully understood, in which.

Numeral references are employed to designate like parts throughout the various figures of the drawing.

DESCRIPTION OF PREFERRED EMBODIMENTS OF THE INVENTION

The roof perimeter and wall transition assemblies are designed to be a part of the roof deck and are fastened to the roof deck. The assembled components form structural units in conjunction with the roof deck and are designed to respond to the forces roof decks typically encounter. The components acting in concert with the roof deck, resist uplift and diaphragm forces and protect the roof deck with an overlap design that accommodates relative movement between adjoining roof decks and other roof structures, such as parapet walls. Terms such as "left," "right," "clockwise," "counter-clockwise," "horizontal," "vertical," "up" and "down" when used in reference to the drawings, generally refer to orientation of the parts in the illustrated embodiment and not necessarily during use. The terms used herein are meant only to refer to relative positions and/or orientations, for convenience, and are not to be understood to be in any manner otherwise limiting. Further, dimensions specified herein are intended to provide examples and should not be considered limiting.

Figure 1:
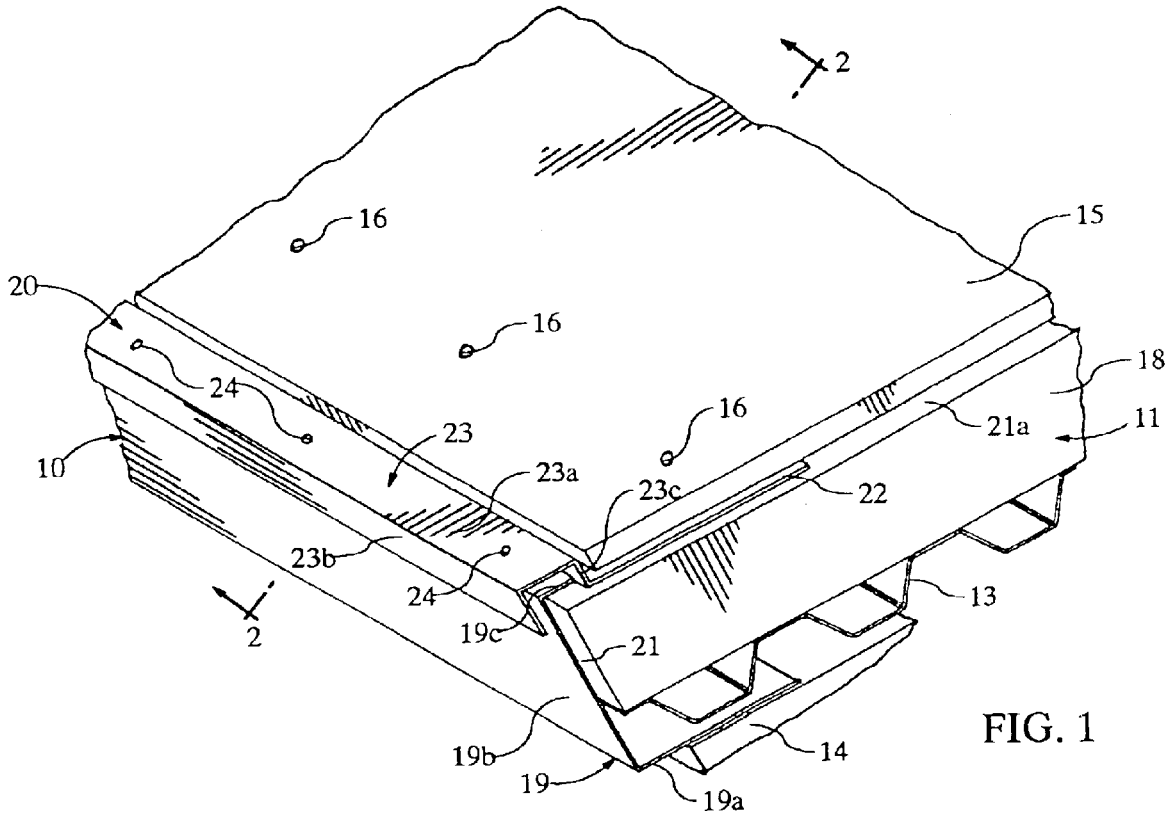
FIG. 1 is a fragmentary perspective view of a roof perimeter transition assembly.
Figure 2:
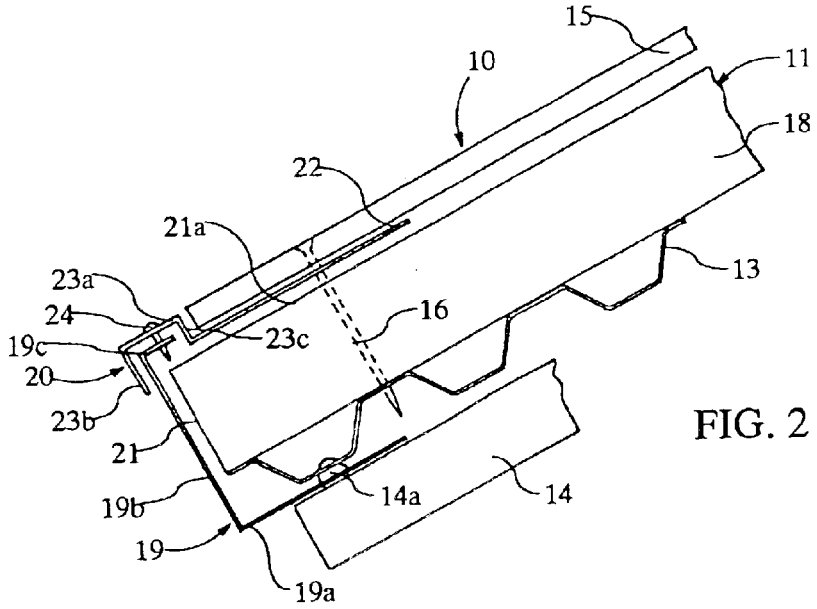
FIG. 2 is a cross-sectional view taken along line 2—2 of FIG. 1.

Referring to FIGS. 1 and 2, the numeral 10 generally designates a roof transition assembly for a roof deck 11 perimeter. Roof deck 11 comprises a sheet of corrugated material 13 anchored to roof beams 14 by attachment means such as a threaded fastener or a plug weld 14*a*, for example as disclosed in U.S. Pat. No. 4,601,151, the disclosure of which is incorporated herein by reference. A rigid substrate board 15, such as mineral board, is secured to the corrugated sheet 13. Interposed between the rigid board 15 and the corrugated sheet 13 is at least one layer of insulation 18. The fasteners 16, which secure substrate board 15, extend through insulation layer 18 to corrugated sheet 13, but do not extend into roof beams 14.

Transition assembly 10 comprises a base component 19 and an upper component 20. Base component 19 is a strip of sheet metal, preferably galvanized steel, with a C-shaped cross-section having generally orthogonal legs 19*a* and 19*b* and a flange 19*c* extending from the distal end of leg 19*b*. The gauge of sheet metal depends on its application, but is typically 20 gauge steel for base components having leg dimensions of 5 inches or less and 18 gauge steel for base components having leg dimensions of 5 inches or greater. All of the assembly components are preferably galvanized steel and, therefore, do not buckle or warp from aging.

Leg 19*a* of base component 19 extends between corrugated sheet 13 and roof beam 14 and is secured to corrugated sheet 13 and roof beam 14 by a fastener or a plug weld that extends through corrugated sheet 13 and leg 19*a* and into roof beam 14, as shown in FIG. 2. Therefore, leg 19*a* must extend into the roof deck far enough for proper securement to the roof deck 11. Leg 19*b* extends generally upwardly along edge 21 of roof deck 11 and flange 19*c* forms a lip that extends over the upper surface 21*a* of the roof deck 11 to provide an anchoring surface for upper component 20.

Upper component 20 similarly comprises a strip of sheet metal, preferably galvanized steel, with a comparable gauge to that of the base component 19. Upper edge component 20 includes an anchoring portion 22 for anchoring component 20 to the roof deck 11 and an inverted channel-shaped connector portion 23 for overlapping with and securing to lip 19*c* of base component 19. Anchor portion 22 extends into the roof deck 11 between the rigid substrate board 15 and insulation 18 and is secured to the roof deck 11 by screw fasteners 16. It can be understood that rigid board 15 is secured to the corrugated sheet 13 by a plurality of fasteners 16, typically in spaced apart rows that correspond to the rows of ribs in the corrugated sheet. Therefore, lip 22 preferably extends into the deck at least a minimum edge distance beyond the first row of fasteners in order to provide sufficient anchorage for normal loading conditions.

Channel-shaped connector portion 23 includes a web 23*a* and a pair of spaced apart flanges 23*b* and 23*c*, as best illustrated in FIG. 2. Spaced apart flanges 23*b* and 23*c* straddle lip 19*c* such that web 23*a* overlaps lip 19*c* and is secured to lip 19*c* by fasteners 24, such as bolts, screws or the like. It should be understood that a removable connection is preferred, but the connector portion 23 can also be welded to the base component 19, either through a plug weld between the web 23*a* and lip 19*c* or a tack weld along the free edge of connector portion 23 and leg 19*b*.

The preferred embodiment illustrates only one method of placement of the transition assembly components. Base component 19 may be secured to the top or bottom of corrugated sheet 13, and upper component 20 may be secured above or below rigid sheet 15. Also, the placement of fasteners 24 is not critical, as long as the base and upper components are secured to one another. Further, the total fasteners used and exact type and placement of fasteners is not critical. Fasteners may be added or deleted as needed for the particular application.

In the first preferred embodiment, it can be seen that the components 19 and 20 generally comprise orthogonal elements. It should be understood, however, that the elements of the components, in other words, the legs, the flanges, and the webs, can be bent or formed to accommodate roof decks that have angled edges or be customized to a desired angle to achieve a different architectural style. Such an arrangement is illustrated In FIG. 3.

Figure 3:
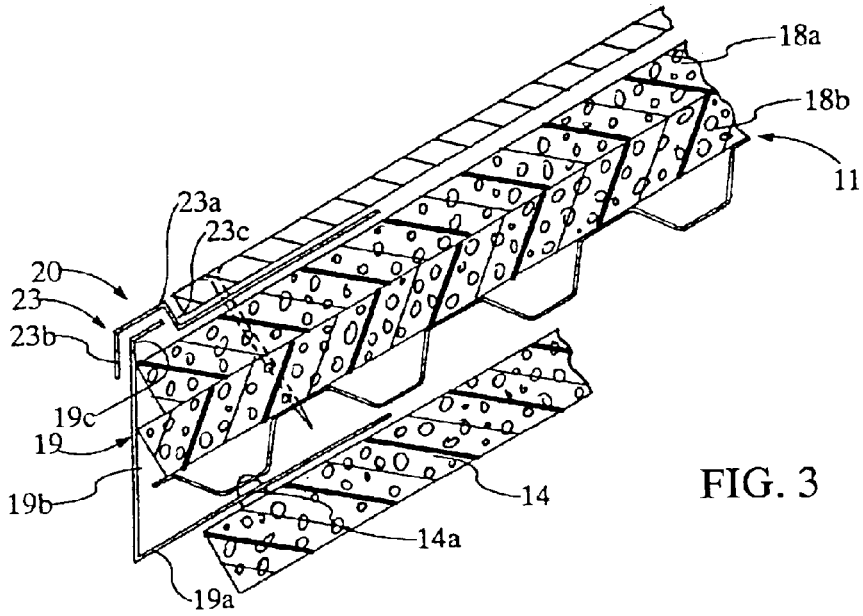
FIG. 3 is a cross-sectional view of a perimeter assembly installed on a roof deck having an incline.

In FIG. 3, roof deck 11 includes two layers of insulation 18*a* and 18*b*, with insulation layer 18*a* inset from insulating layer 18*b*. To accommodate the inset, the legs 19*a* and 19*b* of base component 19 are formed or bent at an acute angle to one another. Lip 19*c* generally forms an obtuse angle with respect to second leg 19*b*, but is approximately parallel to first leg 19*a*. The upper component 120 is modified as well. Flange 23*b* of channel shaped connector portion 23 is bent or formed at an obtuse angle with respect to web 23*a* and is, therefore, not parallel to flange 23*c*. Flange 23*b* preferably is formed at an angle that is complementary to the angle between lip 19*c* and leg 19*b* so that channel-shaped connector portion 23 fits over base member 19 so that the two components will act together as a single structural unit along with the roof deck.

Figure 4:
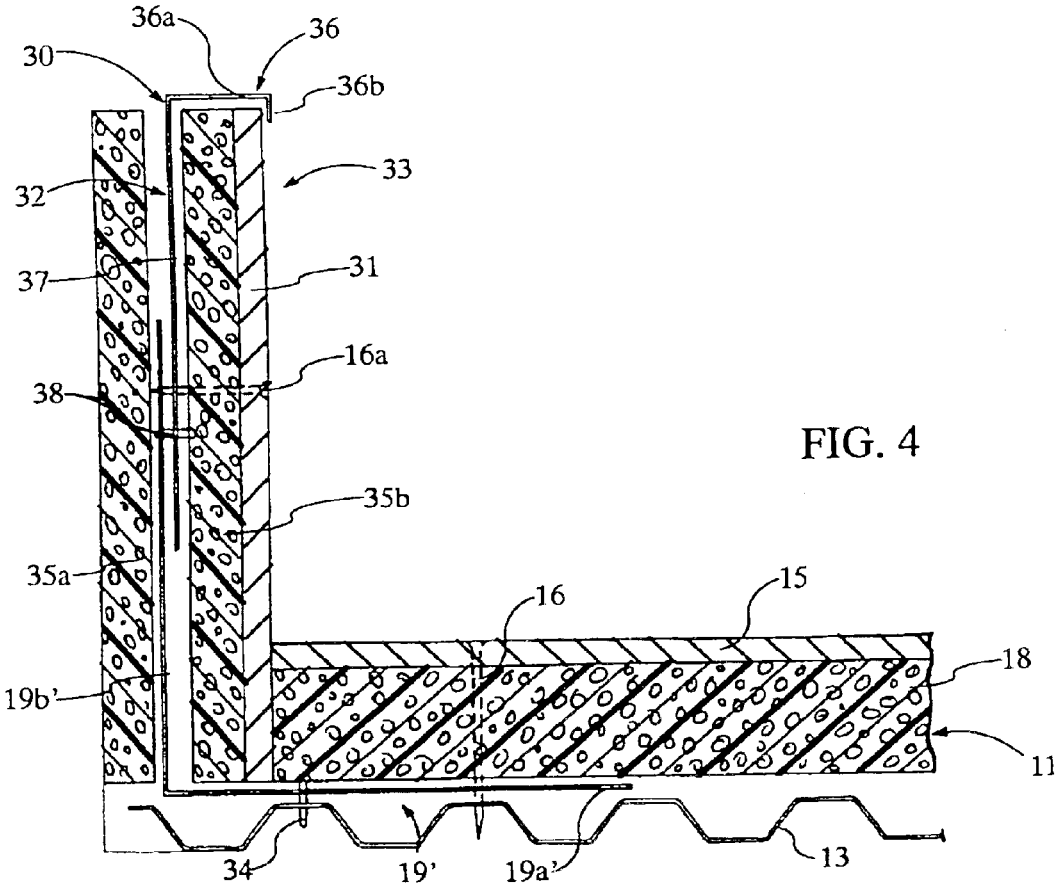
FIG. 4 is a cross-sectional view of a wall transition assembly installed on a roof deck with a parapet wall.
Figure 5:
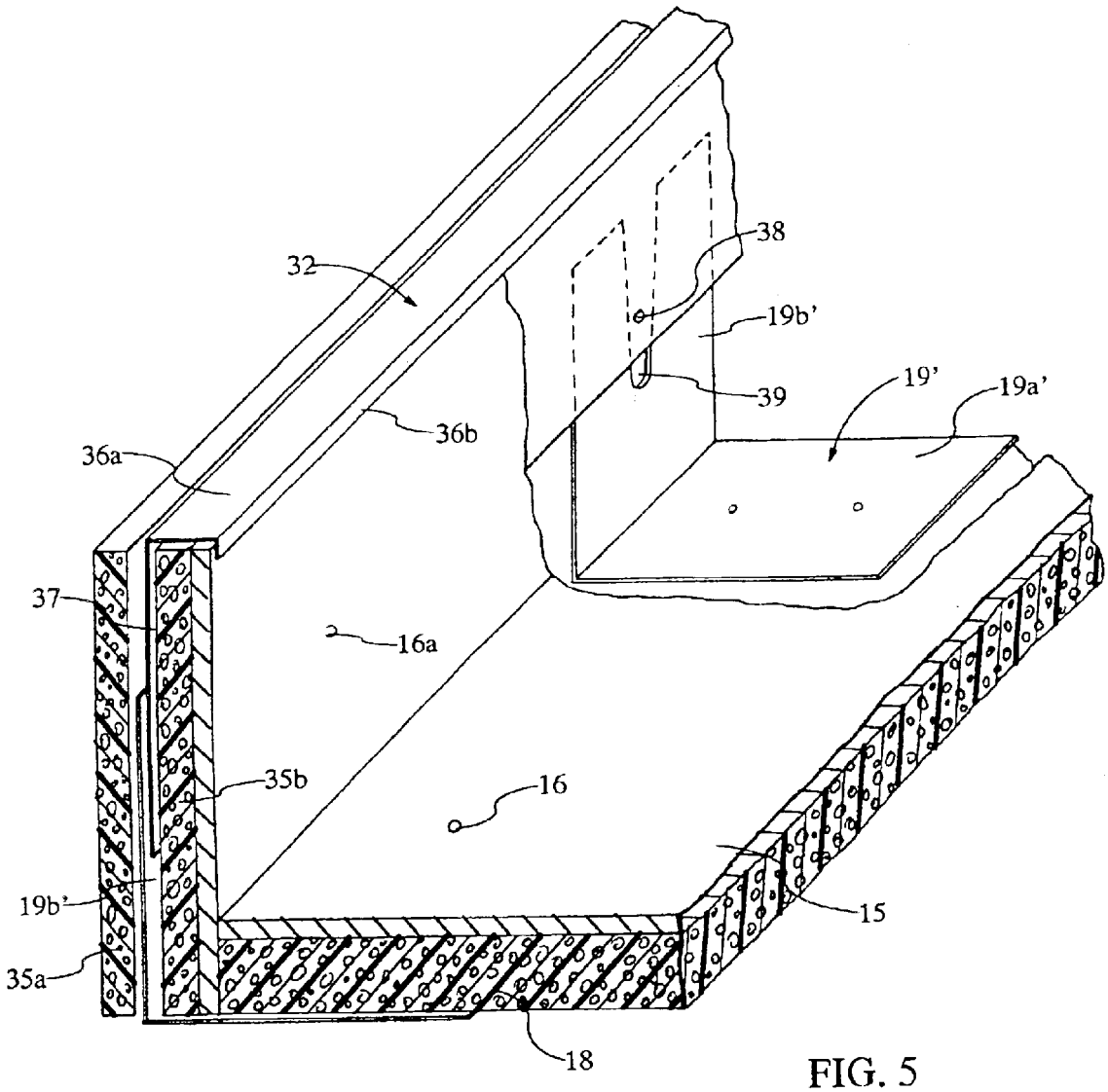
FIG. 5 is a perspective view of the base component of FIG. 4.

The wall transition assembly 30, of FIGS. 4 and 5, is especially suitable for use at the junctures of roof decks and parapet walls. As best illustrated in FIGS. 4, and 5, wall transition assembly 30 includes a plurality of spaced apart base components 19' and a wall component 32. Each base component 19' comprises an L-shaped support member that anchors the wall component 32 to the parapet wall 33 and to the roof deck 11. Preferably, base component 19 has a width comparable to the length of its first and second orthogonal legs 19*a*' and 19*b*'. Leg 19*a*' extends under wall 33 between insulation layer 18 and corrugated sheet 13 of the roof deck 11 and is secured to corrugated sheet 13 by fasteners 16 and fasteners 34. Fastener 16 preferably extends through rigid sheet 15, leg 19*a*' and corrugated sheet 13. It should be understood that the parapet wall increases the length of leg 19*a*' of base component 19'. Consequently, fastener 34 is preferred in order to reduce bending and deflection of base component 19. Fasteners may be added on all transition assembly components as needed. Leg 19*b*' extends up a portion of wall 33 between two layers of insulation 35*a* and 35*b* to provide an anchoring surface for wall component 32.

Wall component 32 comprises a strip of sheet metal, preferably galvanized steel of comparable gauge to the base component 19', with an inverted J-shaped cross-section having a hook portion 36 and a connector portion 37 for extending to and overlapping with the second leg 19*b*' of base component 19'. Hook portion 36 includes a flange 36*a* and a lip 36*b* which over-hang rigid sheet 31 of wall 33 so that when connector portion 37 is secured to second leg 19*b*' of base component 19, flange 36*a* and lip 36*b* will anchor the wall component 32 to the free edge of wall 33 to form a tight connection with wall 33. Connector portion 37 is secured to leg 19*b*' of base member 19 by a fastener 38 that extends through connector portion 37 and leg 19*b*'. To ease installation and adjustment, base component 19' may be provided with a slotted hole 39, as illustrated in FIG. 5. Fastener 16*a*, which extends through rigid substrate 15 and insulation layer 18, preferably extends though leg 19*a*' of base component 19'.

Figure 6:
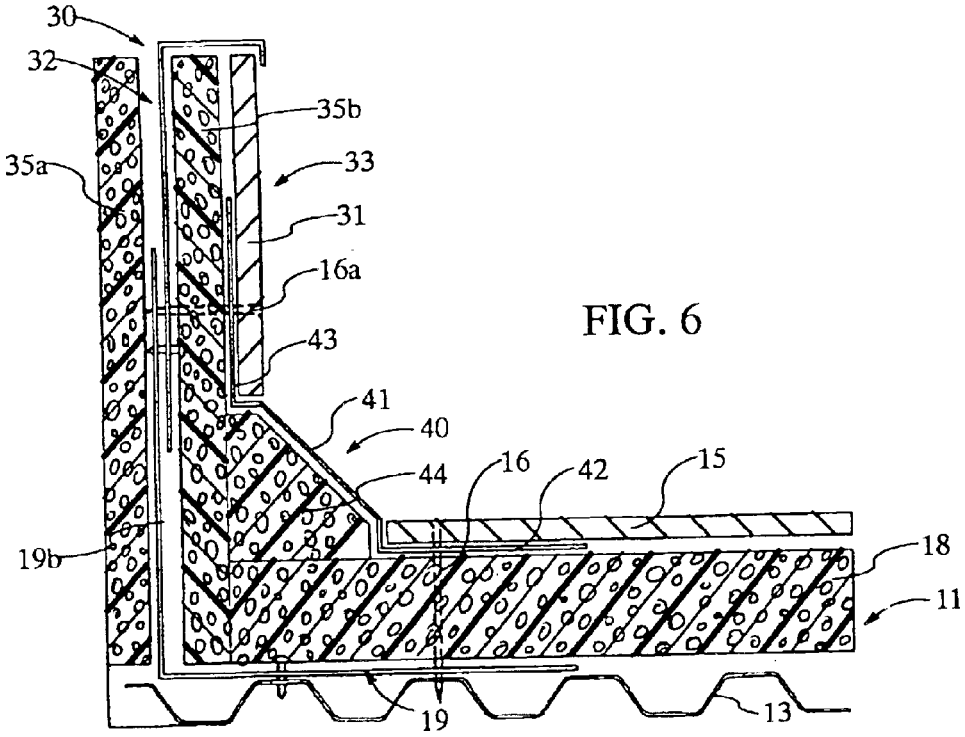
FIG. 6 is a cross-sectional view of the wall transition assembly installed on a roof deck with a canted parapet.

As best illustrated in FIG. 6, wall transition assembly 30 may include a canted component 40. Canted component 40 may be added to improve water run off near the parapet wall 33 or may be desired for aesthetic reasons. Canted component 40 comprises a strip of sheet metal, again preferably galvanized steel of similar gauge to the other transition assembly components, with a substantially C-shaped cross-section. The C-shaped cross-section includes a central portion 41 and a pair of legs 42 and 43 that extend from opposed edges of the central portion 41 at an angle of approximately 135 degrees with respect to the web 41. The angle between the legs 42 and 43 and the central portion 41 is not critical and may be changed for design or aesthetic purposes. Legs 42 and 43 are substantially orthogonal to each other, with leg 42 extending between the rigid board 15 and the insulation layer 18 of the roof deck 11, and with leg 43 extending between the rigid board 31 and insulation layer 35*b* of the parapet wall 33. Leg 42 is secured to roof deck 11 by roof deck fasteners 16 that extend through rigid substrate sheet 15 to the corrugated sheet 13. Similarly, leg 43 is secured to wall 33 by fasteners 16*a* that extend through rigid substrate board 31, insulation layer 35*b*, leg 19*b* of base component 31, and connector 19*b*' of wall component 32.

A wedge shaped backing member 44 of insulation or other material is preferably interposed between the central portion 41 of the canted component 40 and the juncture of the parapet wall 33 and the roof deck 11 so that the canted component 40 will maintain its shape. The presence and material of the backing member 44 is not critical.

Figure 7:
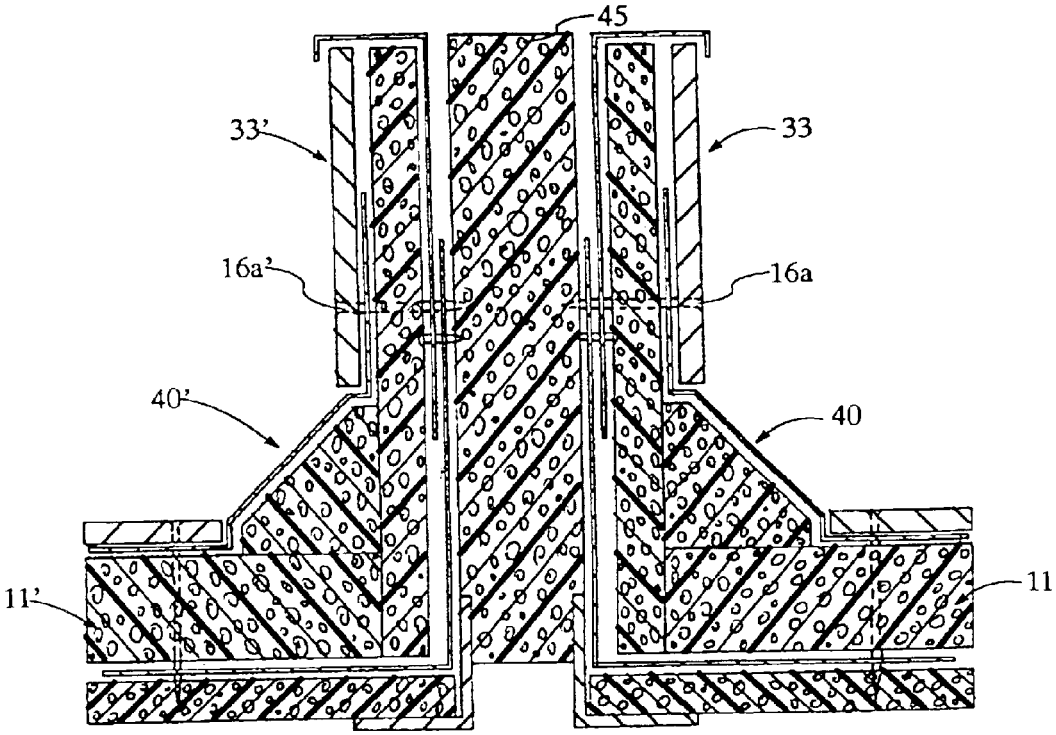
FIG. 7 is a cross-sectional view of the transition assembly installed at an expansion joint of a roof deck.

Wall transition assembly 30 is especially suited for use at expansion joints and can be combined with a second wall transition assembly to ensure that both parapets of the expansion joint are protected. The expansion joint structure illustrated in FIG. 7, is formed at the juncture of two adjoining roof decks 11 and 11' that are spaced apart to accommodate relative movement between the two decks. Deck 11' is similar in construction to roof deck 11 and canted parapet walls 33 and 33' are positioned at the edge of roof decks 11 and 11', respectively. Insulation 45 may be interposed between the two walls 33 and 33' as needed. Wall transition assembly 30 and its mirror wall assembly 30' are provided, which include mirrored canted components 40 and 40'. Fasteners 16*a* and 16*a*', and fasteners 38 and 38' preferably extend into insulation 45.

Figure 8:
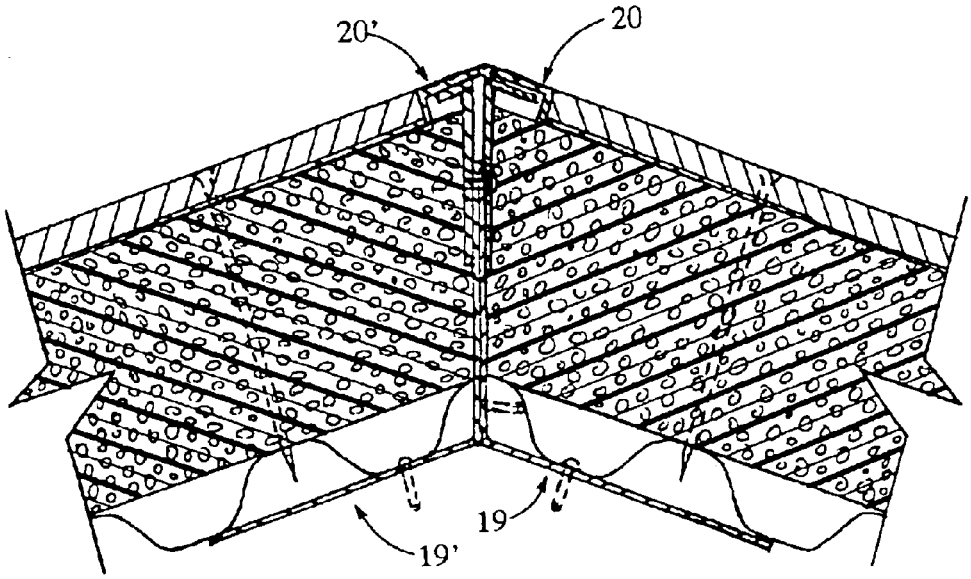
FIG. 8 is a cross-sectional view of the transition assembly installed at a ridge on a sloped roof deck.
Figure 9:
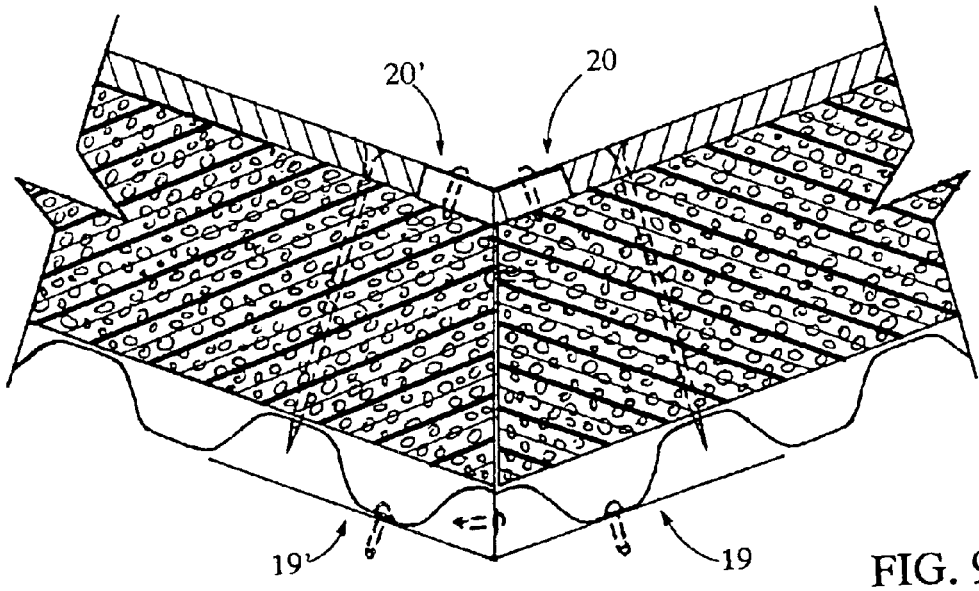
FIG. 9 is a cross-sectional view of a transition assembly installed at a valley formed in a sloped roof deck.

The description provided above has been limited to the roof deck, the roof deck supporting structure, and the transition assemblies, but it should be understood that the present invention may be used in conjunction with flashing and other roof components as needed or desired. Furthermore, it should be appreciated that other and further arrangements of the disclosed structures may be used to achieve similar results on different roofing configurations. For example, in FIGS. 8 and 9, modified perimeter transition assemblies are used in conjunction at roof deck ridges and valleys. The assembly uses mirrored base components 19 and 19' and mirrored upper components 20 and 20' wherein the two assemblies are secured together by fasteners or welds. It should be noted that the transition assembly design eliminates the need for continuous supplemental support from some structural member from below. On a sloped roof, a supplemental support (not shown) is usually an angle iron or a bent steel plate. The edge termination system described herein spans from joist to joist, eliminating the need for continuous support between the joists. Note also that the roof deck termination structure of FIGS. 1, 2 and 3 are configured to carry shear loading to eliminate the need for steel angles for supporting the perimeter of the roof deck.

While a composite roof deck constructed of corrugated sheets, insulation material and rigid sheets of gypsum board has been described herein, it should be appreciated that the roof deck termination structure can be applied to roofs constructed of other materials and assembled in different manners. It is contemplated that the roof deck termination structure will be used in combination with materials conventionally used for commercial and residential roof construction.

Although the preferred embodiments illustrate only one transition assembly for clarity of explanation, typically a plurality of assemblies would be spaced around the parapet wall or the perimeter of the roof deck. The assemblies are placed around the roof deck perimeter to secure components of the roof deck to one another and to provide for stress reduction and roof protection. It is not critical that the same number of base components be used as upper components or wall components. Often a greater number of base components will be employed.

I claim:

1. A roof deck assembly for use adjacent a building wall, the assembly comprising:

a roof deck including a sheet of rigid material above a sheet of corrugated materials;

a substantially vertical sheet of rigid material extending upward from the roof deck and generally orthogonal to the roof deck, the vertical sheet having a free end, the vertical sheet and the roof deck joining at an intersection;

a transition assembly including a base component having a first leg secured to the sheet of corrugated material, a second leg extending generally parallel to and overlapping a portion of the vertical sheet; and an upper component having a connector portion and a free-end portion, the free-end portion extending over the free end of the vertical sheet, the connector portion overlaying and secured to the second leg of the base component.

2. A roof deck assembly according to claim 1, wherein the upper component and the base component are secured to the vertical sheet by a fastener which extends through the connector portion of the upper component and the second leg of the base component and into the vertical sheet.

3. A roof deck assembly according to claim 1, further comprising a cant component, the cant component positioned at the intersection of the vertical sheet and the roof deck, the cant component having a central portion and first and second legs extending from opposed ends of the central portion, the second leg of the cant component secured to the vertical sheet component, and the first leg of the cant component secured to the first leg of the base component.

4. A roof deck assembly according to claim 3, wherein the central portion forms an obtuse angle with the first and second legs of the cant component.

5. A roof deck assembly according to claim 4, wherein said cant component further includes a backing member interposing between the central portion and the intersection between the vertical sheet and the roof deck.

6. A roof deck assembly according to claim 3, wherein the first leg of the cant component is secured between the rigid material of the roof deck and the corrugated material of the roof deck, and wherein the second leg of the cant component is secured between the vertical sheet and the connector portion of the upper component.

7. An assembly as in claim 1 wherein the free end portion of the upper component extends across the free end of the vertical sheet and down the side of the vertical sheet opposite the connector portion.

8. An assembly as in claim 1 wherein the upper and base components are separate pieces.

9. An assembly as in claim 1 wherein the first leg of the base component is above the corrugated sheet.

10. An assembly as in claim 1 wherein the second leg of the base component includes a slot for receiving a fastener.

11. An assembly as in claim 1 further comprising a plurality of base components connected to the corrugated sheet and the upper component.

12. An assembly as in claim 1 further comprising at least one sheet of insulation.

13. A roof deck assembly for use adjacent a building wall, the assembly comprising:

a roof deck including a sheet of rigid material above a sheet of corrugated material;

a substantially vertical sheet of rigid material extending upward from the roof deck and having a free end, the vertical sheet and the roof deck forming an intersection;

a transition assembly connecting the vertical sheet and the roof deck, the transition assembly having a first leg connected to the corrugated sheet, a substantially vertical portion connected to the vertical sheet and a free end portion extending over the free end of the vertical sheet.

14. An assembly as in claim 13 wherein the transition assembly comprises two components, a base component and an upper component, the components secured to one another.

15. An assembly as in claim 13 wherein the base component has a substantially vertical leg and the upper component has a substantially vertical leg and wherein the vertical legs of the components are secured one to another.

16. An assembly as in claim 15 wherein the vertical legs are secured to the vertical sheet and to one another by a fastener extending through each leg and the vertical sheet.

17. An assembly as in claim 13 wherein the free end portion of the transition assembly has a J-hook cross-section.

18. An assembly as in claim 13 wherein the first leg is above the corrugated sheet.

19. A roof deck assembly for use at an expansion joint, the assembly comprising:

a first transition assembly having a first sheet of rigid material above a sheet of corrugated material, a first substantially vertical sheet of rigid material extending upward and generally orthogonal to the first sheet of rigid material, the vertical sheet having a free end, the vertical sheet and the first rigid sheet forming an intersection, the first transition assembly including a base component having a first leg secured to the sheet of corrugated material, a second leg extending generally parallel to and overlapping a portion of the first vertical sheet, and an upper component having a connector portion and a free-end portion, the free-end portion extending over the free end of the first vertical sheet, the connector portion overlaying and secured to the second leg of the base component; and a second transition assembly substantially mirroring the first transition assembly; and the first and second transition assemblies bridging a roof expansion joint.

* * * * *